US008043086B2

(12) United States Patent
Schmidt et al.

(10) Patent No.: US 8,043,086 B2
(45) Date of Patent: Oct. 25, 2011

(54) METHOD AND DEVICE FOR COOLING OR QUENCHING SLABS AND SHEETS WITH WATER IN A COOLING POND

(75) Inventors: Dirk Schmidt, Mettmann (DE); Harald Wehage, Llsenburg (DE); Frank Werner, Heiligenhaus (DE); Günter Thüs, Ratingen (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/555,854

(22) PCT Filed: May 6, 2004

(86) PCT No.: PCT/EP2004/004830

§ 371 (c)(1),
(2), (4) Date: Nov. 5, 2005

(87) PCT Pub. No.: WO2004/098804

PCT Pub. Date: Nov. 18, 2004

(65) Prior Publication Data

US 2006/0292513 A1 Dec. 28, 2006

(30) Foreign Application Priority Data

May 7, 2003 (DE) ..... 103 20 651
May 6, 2004 (DE) ..... 10 2004 023 031

(51) Int. Cl.
*C21D 1/63* (2006.01)
*C21D 1/667* (2006.01)

(52) U.S. Cl. ..... 432/85; 266/130; 266/132; 148/660

(58) Field of Classification Search ..... 432/77, 432/85; 266/111–114, 46, 259, 130–133; 148/559, 574, 575, 660, 661, 664
See application file for complete search history.

(56) References Cited

U.S. PATENT DOCUMENTS

| | | | | |
|---|---|---|---|---|
| 2,341,766 | A * | 2/1944 | Fox | 266/132 |
| 3,186,698 | A * | 6/1965 | Thome | 266/113 |
| 3,323,577 | A * | 6/1967 | Clumpner | 266/113 |
| 3,556,877 | A * | 1/1971 | Ujiie | 266/130 |
| 3,680,344 | A * | 8/1972 | Manthey et al. | 72/201 |
| 3,706,544 | A * | 12/1972 | Michalik | 65/116 |
| 3,725,024 | A * | 4/1973 | Sperry | 65/114 |
| 3,738,629 | A * | 6/1973 | Coleman | 266/130 |

(Continued)

FOREIGN PATENT DOCUMENTS

DE 25 48 154 5/1977

(Continued)

*Primary Examiner* — Gregory A Wilson
(74) *Attorney, Agent, or Firm* — Lucas & Mercanti, LLP; Klaus P. Stoffel

(57) ABSTRACT

The invention concerns a method for cooling or quenching slabs and sheets (2) with water in a cooling pond (1, 14) wherein the slabs and the sheets (2), previously set upright by a tilting device (18), are lowered and temporarily maintained in position on edge. The inventive method is characterized in that the slabs and the sheets are sprayed with the cooling water. Therefor, the cooling pond (1) has, on both sides of the lowered slabs and sheets (2) jet devices (10; 11*a*, 11*b*) directed towards the surfaces of the large sides of the slabs or sheets and connected to a cooling water circuit which comprises means for reducing the water filling supply from a maximum upper water level (13*b*) to a lower water level (13*a*).

11 Claims, 4 Drawing Sheets

U.S. PATENT DOCUMENTS

| | | | | | |
|---|---|---|---|---|---|
| 3,782,916 | A | * | 1/1974 | Powell et al. | 65/104 |
| 3,829,072 | A | * | 8/1974 | Fieser et al. | 266/51 |
| 3,870,570 | A | * | 3/1975 | Fieser et al. | 148/202 |
| 3,942,967 | A | * | 3/1976 | Jack et al. | 65/114 |
| 4,036,243 | A | * | 7/1977 | Manthey et al. | 266/132 |
| 4,088,309 | A | | 5/1978 | Zurmahr | |
| 5,679,307 | A | * | 10/1997 | Mantovan et al. | 266/132 |
| 5,795,538 | A | * | 8/1998 | Abukawa et al. | 266/130 |
| 5,820,705 | A | * | 10/1998 | Yu et al. | 148/633 |
| 6,250,370 | B1 | * | 6/2001 | Tada et al. | 164/486 |

FOREIGN PATENT DOCUMENTS

| | | |
|---|---|---|
| EP | 0195658 | 9/1986 |
| EP | 0 755 732 | 1/1997 |
| EP | 0 960 670 | 12/1999 |
| JP | 52066811 | 6/1977 |
| JP | 59034771 | 8/1984 |
| JP | 60009834 | 1/1985 |
| JP | 61217531 | 9/1986 |

* cited by examiner

METHOD AND DEVICE FOR COOLING OR QUENCHING SLABS AND SHEETS WITH WATER IN A COOLING POND

The invention concerns a method and a device for cooling or quenching slabs and sheets with water in a cooling basin, into which the slabs and sheets, which have first been set upright by a tilting device, are lowered and temporarily maintained on edge.

DE 25 48 154 A describes a cooling device for cooling slabs. It comprises a cooling basin for holding cooling water and a locating frame with compartments in the cooling basin for vertically locating the slabs by means of a traveling crane that travels above or along the cooling basin. The crane grips the slabs in an upright position with suitable gripping devices, places them in the locating frame, and lifts them back out after they have cooled. To erect the slab pushed over by a run-in roller table on edge onto the narrow end face, a tilting device is installed at the front end face of the cooling basin. Two independent tilting devices are also located in the region of the run-in and run-out roller tables for placing the slabs in an upright position and laying them on their sides.

However, the cooling rate that can be achieved with this device during the quenching (hardening and tempering) of sheets and slabs results in a protracted quenching operation. In addition, due to the nonuniform cooling rates over the surface of the sheets or slabs, it is not possible to prevent the treated material from becoming wavy and uneven. Therefore, an additional straightening operation is generally necessary after the quenching operation.

The objective of the invention is to develop a method and a device of the aforementioned type, with which the specified disadvantages can be avoided and the quenching can be accomplished with better quality.

In accordance with the invention, the objective with respect to the method is achieved by directing jets of cooling water at the slabs and sheets. Since the quenching is no longer carried out in the still water of the cooling basin, but rather the systematic directing of jets of cooling water produces a large constant flow in the water, higher and more uniform cooling rates can be achieved than with the conventional cooling processes. Not only are waviness and unevenness clearly minimized, but also the flow-assisted cooling leads to improved microstructural and material properties of the treated sheets and slabs.

A preferred embodiment of the invention provides that the slabs and sheets are completely submerged in a cooling basin filled with water, and, in addition, jets of cooling water are directed at the slabs and sheets in the water bath of the cooling basin. This makes it possible to carry out a sort of whirlpool quenching or cooling.

An alternative embodiment provides that the water level in the cooling basin is lowered, and the slabs and sheets are placed in the cooling basin with their lower edges spaced some distance from the water level, and cooling water is directed at the slabs and sheets. In one and the same cooling installation, it is thus possible to vary the cooling process, depending, for example, on the grade of the material, and to carry out the cooling process either as a jet operation or a whirlpool operation in the same cooling installation without other or additional equipment, at the same time taking into account variable fresh water requirements, variable temperature of the material to be cooled, and variable water temperature, in each case proceeding on the basis of an initial temperature and a final temperature, which can also vary.

In this regard, it is advantageous to base the cooling system on a physical-mathematical cooling model.

A fundamental problem in accelerated cooling is the exact description of the behavior with respect to time of the temperature fields within the rolled product. Calculation with the use of mathematical models is a suitable aid for the planning, control and optimization of the process.

The physical-mathematical cooling model describes the nonsteady time-temperature behavior of the sheet with the boundary conditions of the temperature-dependent physical characteristics and with the heat-transfer coefficient, which depends on the local surface temperature of the slab/sheet. The temperature distribution over the thickness of the product to be cooled can be computed by dividing the slab/sheet into individual layers and using the finite-element method and the Fourier law of heat conduction.

The following computations can be carried out with the cooling model:

- computation of the cooling rate at a given water flow rate;
- computation of the amount of water necessary for a predetermined cooling rate;
- cooling time.

The material characteristic data are determined according to the alloy components or the material characteristic class for each product to be cooled. These temperature-dependent material characteristic data are then used to carry out the corresponding computations.

It is possible to carry out the cooling computations in offline mode from an external workstation. The results can be stored in a process control system (PCS). On request, these data can be made available to the process computer of the cooling system. Basically, all computations are performed on the process computer of the cooling model, and the following data are delivered to the automation system:

- material identification and alloy components
- sheet thickness
- initial cooling temperature
- final cooling temperature
- cooling rate or maximum water flow.

The required amount of water or cooling rate and the corresponding cooling curves for the slab or sheet are computed on the basis of this data. The cooling model can also be used for offline simulation of computations. In this regard, it is possible, for example, to compare different cooling rates for different amounts of water for the purpose of optimizing the cooling process. These offline computations can be initiated by the dialog described above. It is thus possible to return a protocol with the most important parameters and operating results to the process control system (PCS). It is also possible to incorporate parameters and coefficients for material and boundary conditions, e.g., in the temperature model.

Other refinements of the invention provide for incorporation of the water pressure and/or the volume flow from the cooling water jets and the distance of the jet devices from the surface of the slabs and sheets.

In a device of this general type for the cooling or quenching of slabs and sheets, the cooling basin has, in accordance with the invention, jet devices, which are arranged on both sides of the lowered slabs/sheets, are directed towards their broadside surfaces, and are connected to a cooling water circulation, which has means for lowering the water level from a maximum, upper water level to a low, lower water level. In this way, it is possible, for example, for the nozzles of nozzle banks that are centrally supplied with cooling water, to direct the additional cooling water towards the slab or sheet directly at the site of the event after the slab or sheet has been properly located. In this regard, a constant nozzle distance is maintained over the entire surface; this distance can be 10-500 mm, depending on the required profile. In order to maintain an equal distance between the nozzle banks and the lowered, vertically located sheet or slab, the sheet or slab can be appropriately oriented by means of a hydraulically operated pressure contact device.

A preferred embodiment of the invention provides that the cooling basin is designed with tracks for a raisable and lowerable carriage that holds a slab or a sheet. The carriage can be run in and run out very quickly. The residence time for the quenching of slabs or sheets in the cooling basin is greater than 30 minutes.

In accordance with a proposal of the invention, the carriage is connected with a cable drive, which preferably has cables that are guided on cable drums mounted on the carriage. The cable drums are mechanically coupled with a frequency-controlled three-phase motor. The vertical lowering and raising can be accomplished with the cable drive in an extremely short interval of time; the time interval for complete immersion of a slab or sheet is less than 10 seconds.

The ability of the carriage to run smoothly is enhanced if it runs on the tracks on rollers/wheels.

Additional features and details are specified in the claims and in the following description of the specific embodiments of the invention that are illustrated in the highly schematic drawings.

Figure 1:
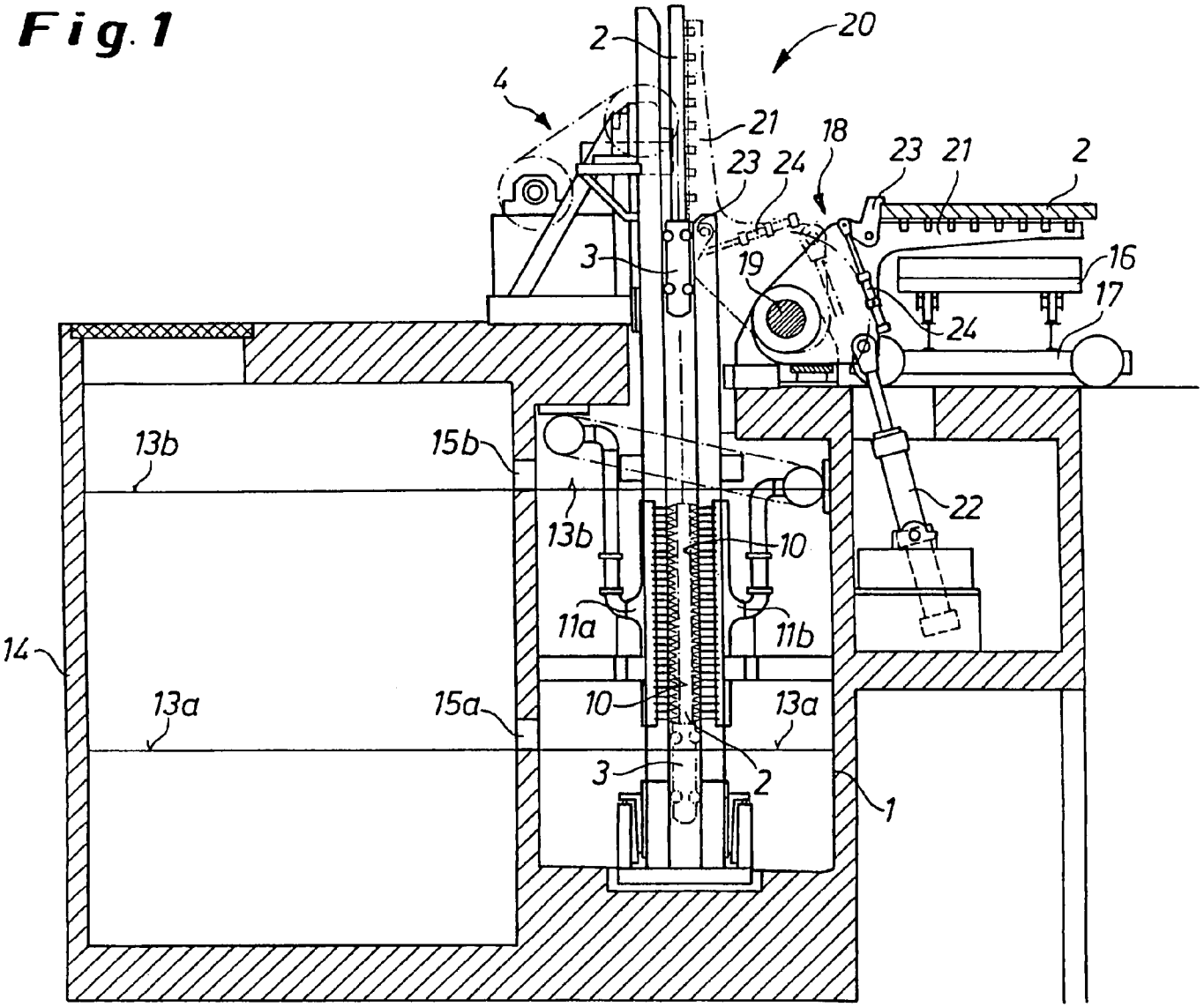
FIG. 1 is a detail drawing of a cooling installation that has two cooling basins located side by side and shows a cross section through the cooling basins with the tilting device assigned to them and the lowering and raising device for locating the slabs/sheets.

The cooling installation 20 shown in FIG. 1 consists of a cooling basin 1 and a pump receiving basin 14 adjacent to it. The two basins 1 and 14 are connected with each other by flow connections in the form of a lower and an upper overflow 15*a* and 15*b*, respectively. The hot slabs/sheets 2 are fed, e.g., after austenitization, into the cooling installation 20 positioned over a traversing platform 17 and lying on a furnace car 16 arriving from a heating furnace. A hydraulically operated tilting device 18 is used to raise the hot slab/sheet 2 from the furnace car 16, erect it vertically on edge, and transfer it to a carriage 3 that can be raised and lowered.

The tilting device 18, which is assigned to the front, right cooling or quenching basin 1, has a rotatably supported shaft 19, on which lifting arms 21 are supported, which are in a horizontal position to receive the slab/sheet 2 and can be passed by the furnace car 16 with the supported slab/sheet 2. The lifting arms 21 are turned or swiveled 90° by hydraulic cylinders 22 from the horizontal position to the transfer position, in which the slab/sheet 2 is positioned vertically on edge. During the erecting operation, the slab/sheet 2 is supported on its bottom edge by latches 23, which can be acted upon by hydraulic cylinders 24. Position is detected by a position sensor (not shown), and the fed slab/sheet 2 is erected after manual release into an automatic sequence. To receive the slab/sheet 2, the carriage 3 is raised slightly, which causes the slab/sheet 2 to be released from the latches 23, which can then be swung out of the way. The carriage 3 is then lowered very quickly to cool the slab/sheet 2. After complete cooling, the slab/sheet 2 is removed in automatic mode in the reverse manner from that described above for locating the slab/sheet. The cooled slab/sheet 2 then lies either on the furnace car 16 again or can be removed with the bay crane. In the case of removal with the bay crane, the traversing platform 17 must be moved laterally.

Figure 3:
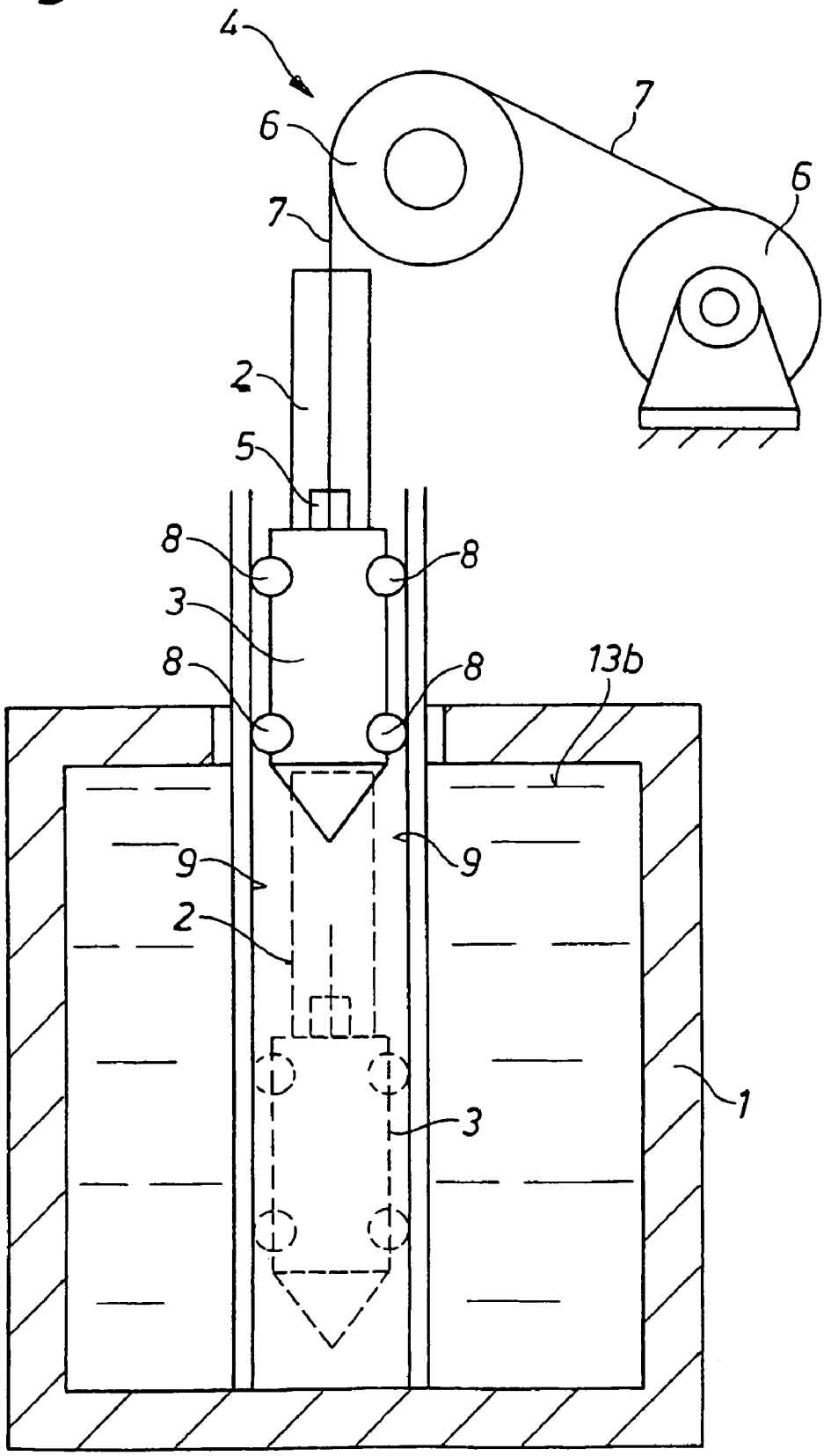
FIG. 3 is a schematic drawing of detail from FIG. 1 and shows a cross section through the basin that receives the located product to be cooled, which is the basin on the right in FIG. 1.

FIG. 3 shows a slab 2 that has been set vertically on edge and placed in the carriage 3. To raise and lower the carriage 3 with the slab 2 in the cooling basin 1, the carriage 3 is connected to a cable drive 4, which has cables 7, which are guided by cable drums 5 mounted on the carriage 3 after running over guide pulleys 6. A frequency-controlled three-phase motor (not shown) with reduction gearing acts on the cable drums 5 by mechanical coupling by Cardan shafts. The carriage 3, which is guided by rollers or wheels 8, runs on tracks 9 provided in the cooling basin 1. The position of the carriage 3 and slab 2 in which they are completely lowered into the cooling basin 1 is indicated in FIG. 3 by broken lines.

Figure 2:
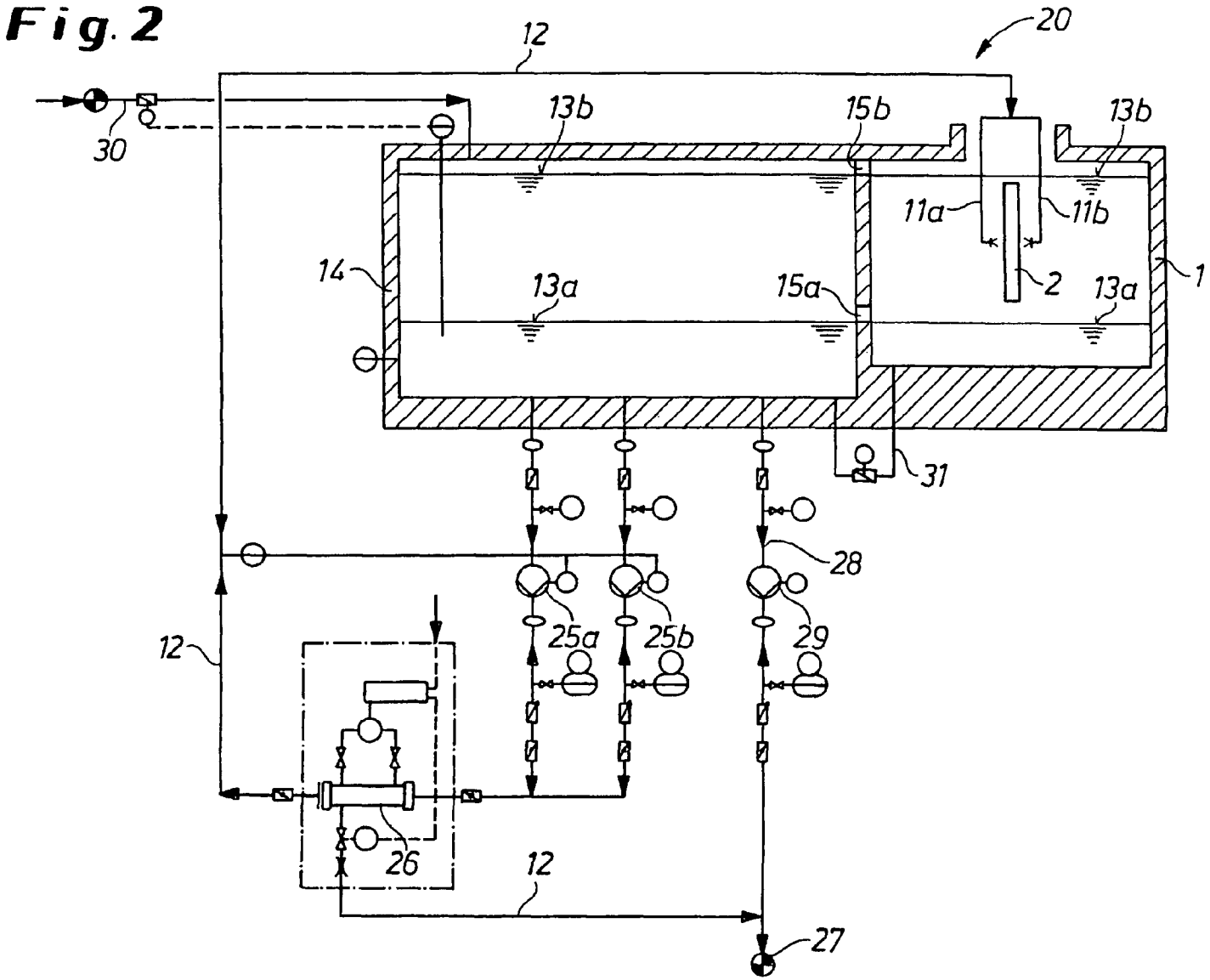
FIG. 2 shows the two cooling basins according to FIG. 1 and illustrates the cooling water circulation for quenching the slabs/sheets.

Nozzle banks 11*a*, 11*b* (cf. FIGS. 4 and 5), which are installed in the cooling basin 1 between the tracks 9 and have nozzles 10 that are directed towards the broadside surfaces of the slab/sheet 2, are assigned to the slabs/sheets 2 that have been positioned as described above. The nozzle banks 11*a*, 11*b* are connected to a cooling water circulation 12, as FIG. 2 shows in greater detail.

The cooling water circulation 12 allows variable cooling and cooling processes and ensures the supply of the nozzle banks 11*a*, 11*b* in the quenching basin 1 for cooling slabs/sheets 2 both in a pure jet operation and in the manner of a whirlpool operation. In this regard, it is possible to distinguish, for example, three cases:

jet operation: for HV steels up to 15 t whirlpool operation: for HV steels up to 15 t and high-grade steels up to 10 t water basin: for HV steels and high-grade steels up to 10 t.

In the jet operation, cooling water is directed towards the slab/sheet 2 by the nozzle banks 11*a*, 11*b*. The maximum, low water level 13*a* in the quenching basin 1, as well as in the adjacent pump receiving basin 14, is below the lower edge of the slab/sheet 2 during the cooling operation.

The cooling water is drawn in from the pump receiving tank 14 by the pumps 25*a*, 25*b* and pumped through a filter 26 to the nozzle banks 11*a*, 11*b*. A speed controller for the pumps 25*a*, 25*b* allows well-defined cooling water delivery, depending on the size and thickness of the sheet.

The filter 26 has the function of retaining particles of scale that are larger than the nozzle orifices and could thus clog the nozzles. It is flushed with its own medium after each cooling operation. The flushing water is conveyed to a scale drain channel 27, which also helps to lower the water level after the cooling process. Most of the scale settles at the bottom of the cooling basin 1, so that the bottom of the basin must be cleaned from time to time.

The water running off the slab/sheet 2 is collected in the basin 1, from which it enters the pump receiving basin 14 through an overflow 15*a*.

Figure 5:
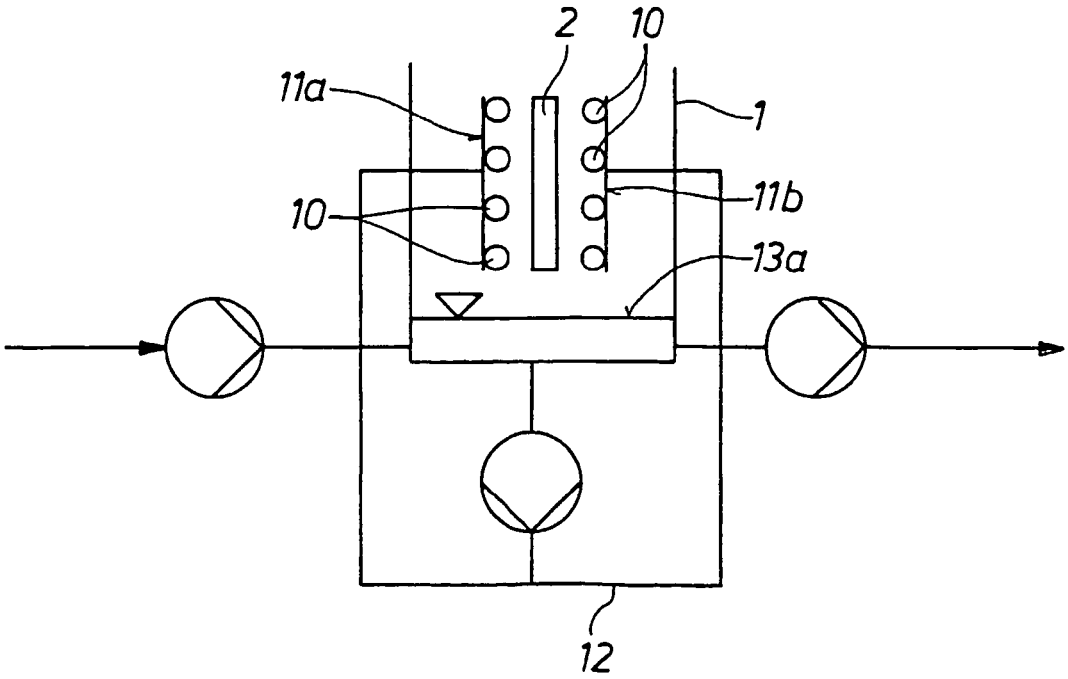
FIG. 5 shows a highly simplified schematic diagram of another cooling process to be carried out in the cooling installation according to FIG. 2.

FIG. 5 shows a highly schematic drawing of this cooling process. In this cooling process by quenching of the slab/sheet 2 in the jet operation, in which the cooling water is directed at the slab/sheet 2 from the nozzles 10 of the nozzle banks 11*a*, 11*b*, a make-up water and wastewater connection 28 (cf. FIG. 2) remains closed during the cooling. Due to the low storage volume in the jet operation, the permissible upper limit of the water temperature can already be reached in a single cooling. operation. Therefore, after the cooling process, a portion of the heated water is pumped out into the scale drain channel 27 by a pump 29. Fresh water from a direct cooling water intake 30 is then supplied until the initial temperature is reached again.

The amount by which the water level is lowered and the amount of fresh water that must be resupplied depend on the final temperature of the last process and on the initial temperature of the next cooling process. The amount of water removed and the amount of fresh water resupplied are controlled via the level in the pump receiving basin 14. When there is a high cooling requirement, the level in the basin 1 can be additionally lowered by a bypass 31.

Figure 4:
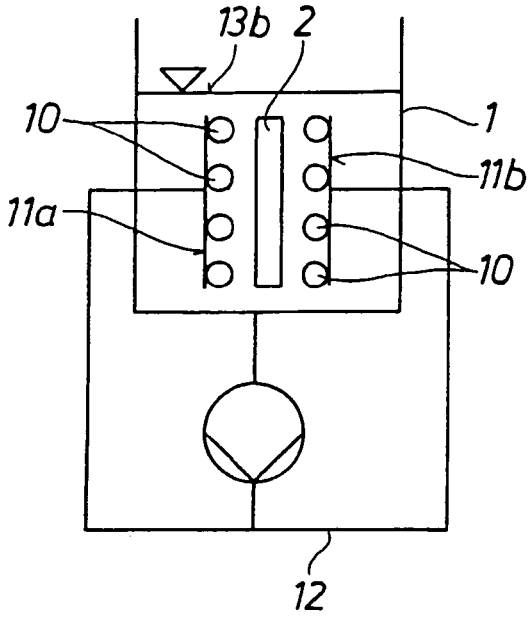
FIG. 4 shows a highly simplified schematic diagram of a cooling process to be carried out in the cooling installation shown in FIG. 1.

FIG. 4 shows another cooling process, again in a highly schematic way. In the same cooling installation or cooling basin 1 as before for the jet operation, a quenching process involving a whirlpool operation, i.e., with a constant powerful flow, is made possible, as is also indicated in FIG. 3 by the wave lines in the cooling basin.

In the whirlpool operation, the slab/sheet 2 is immersed in the basin 1, which is filled to the high water level 13*b*, and at the same time is acted upon by water from the cooling banks 11*a*, 11*b*. The water is forced to circulate by the nozzles 10—free convection becomes forced convection, which allows better heat transfer from the slab/sheet 2 to the water than a simple immersion bath.

The function of the filter 26 and the pumps 25*a*, 25*b* and the pump 29 is fresh water control, the same as in the jet operation. However, due to the greater storage volume in the whirlpool operation, a higher initial cooling temperature is possible, or, starting from a low initial cooling temperature, several cooling operations can be carried out until the permissible upper limit of the water temperature is reached.

Depending on the grade of the material and the required properties (microstructure), it is thus possible, in the same cooling installation 20, without additional units of equipment, to change the cooling processes, for which a cooling model is stored. The entire cooling process is controlled according to a physical-mathematical cooling model by a master computer, which also allows automatic control of the water temperature, the water pressure, the volume flow, and the distance of the nozzles of the nozzle banks from the surface of the slab or sheet. Besides a whirlpool operation or a jet operation, cooling by an immersion operation without directing jets of water against the slab or sheet is also optionally possible in the same cooling installation 20.

The invention claimed is:

1. Method for cooling or quenching metal slabs and metal sheets (2) with water, comprising the steps of: setting the slabs and sheets upright with a tilting device (18); lowering the slabs and sheets vertically into a cooling basin (1, 14) containing water and temporarily maintaining the slabs and sheets on edge so that the slabs or sheets define a vertical plane; directing cooling water laterally to the plane of the slabs or sheets and against both sides of the slabs and sheets (2) when in the cooling basin; and changing a level of the water in the cooling basin so that the slabs and sheets are sprayed with the water when both above and below the level of the water in the cooling basin.

2. Method in accordance with claim 1, wherein the slabs and sheets (2) are fully immersed in the cooling basin (1) filled with water, and, in addition, the cooling water is directed against them in the water bath of the cooling basin (1).

3. Method in accordance with claim 2, wherein a water level in the cooling basin (1, 14) is lowered, the slabs and sheets (2) project above the water level (13*a*), and the cooling water is directed at the slabs and sheets (2).

4. Method in accordance with claim 1, wherein the cooling water is directed by jets, and the water pressure and/or the volume flow of the cooling water jets is automatically controlled.

5. Method in accordance with claim 4, wherein the distance of the jets (10; ll*a*, 11*b*) from the surface of the slabs and sheets (2) is automatically controlled.

6. Device for cooling or quenching metal slabs and metal sheets (2) with water in a cooling basin (1, 14), into which the slabs and sheets, which have first been set upright by a tilting device (18), are lowered and temporarily maintained on edge, especially for carrying out the method in accordance with claim 1, wherein the cooling basin (1) has jet devices (10; 11*a*, 11*b*), which are arranged on both sides of the lowered vertically arranged slabs/sheets (2), are directed laterally to the plane of the slabs/sheets and towards broadside surfaces of the slabs/sheets, and are connected to a cooling water circulation (12), which has means (25*a*, 25*b* and 29) for lowering the water level in the cooling basin from a maximum, upper water level (13*b*) to a low, lower water level (13*a*) so that the slabs and sheets are selectively sprayed with the water when both above and below the level of the water in the cooling basin.

7. Device in accordance with claim 6, wherein the cooling basin (1) is connected by flow with a pump receiving basin (14).

8. Device in accordance with Clam 6, and further comprising a raisable and lowerable carriage (9), wherein the cooling basin (1) is designed with tracks (9) for the raisable and lowerable carriage (3) that holds a slab or a sheet (2).

9. Device in accordance with claim 8, wherein the carriage (3) is connected to a cable drive (4).

10. Device in accordance with claim 9, wherein the cable drive (4) has cables (7), which are guided by cable drums (5) mounted on the carriage (3), and the cable drums (5) are mechanically coupled with a frequency-controlled three-phase motor.

11. Device in accordance with claim 8, wherein the carriage (3) is guided on the tracks (9) by rollers or wheels (8).

* * * * *